United States Patent [19]

Watts et al.

[11] 4,201,237

[45] May 6, 1980

[54] PIVOTAL FRAME STRUCTURE FOR COLLAPSIBLE UMBRELLA TYPE TENT

[76] Inventors: Paul J. Watts, 1204 E. 8285 South, Sandy, Utah 84074; Lynn D. Crawford, 3364 Sunnybrooke Dr., Salt Lake City, Utah 84119; Philip T. Nichols, 3950 Squire Crest Dr., Salt Lake City, Utah 84118

[21] Appl. No.: 950,029

[22] Filed: Oct. 10, 1978

[51] Int. Cl.[2] ..... A45B 25/08

[52] U.S. Cl. ..... 135/2; 135/3 E; 135/30; 135/31; 135/32

[58] Field of Search ..... 135/28, 29, 30, 31, 135/32, DIG. 9, 20 R, 2

[56] References Cited

U.S. PATENT DOCUMENTS

| | | | |
|---|---|---|---|
| 768,298 | 8/1904 | Plante | 135/29 |
| 1,141,494 | 6/1915 | Schultz et al. | 135/28 |
| 1,264,075 | 4/1918 | Hout | 135/29 |
| 2,442,931 | 6/1948 | Morgan | 135/28 |
| 2,474,516 | 6/1949 | Daniel | 135/28 |
| 3,177,882 | 4/1965 | Militano | 135/28 |

FOREIGN PATENT DOCUMENTS

| | | | |
|---|---|---|---|
| 974202 | 11/1964 | United Kingdom | 135/29 |

*Primary Examiner*—Reinaldo P. Machado
*Attorney, Agent, or Firm*—Criddle & Western

[57] ABSTRACT

A collapsible shelter of the umbrella-tent type including a foldable frame and a cover of sheet material affixed to the frame. The tent frame comprises a plurality of support members and novel means of pivotally connecting the mutually respective ends of the support members to a central hub. The central hub is mounted on erecting guide means, which preferably has the form of an erecting rod or cord. A second hub is mounted on the guide means below the central hub, and a plurality of rib members are pivotally connected at mutually respective ends to the second hub, using novel connecting means similar to that used with the support members. The other ends of the rib members are pivotally connected to corresponding, respective support members, so that when the shelter is in its erected form, the support members extend outwardly and downwardly from the central hub, the second hub is positioned adjacent or proximate to the central hub, the rib members extend substantially radially outwardly from the erecting guide, and the cover is held tautly affixed to the frame. The novel connecting means comprise neck portions in the first and second hubs, respectively, with ring members encircling the respective neck portions. Circular, ring-shaped hooks are provided on the respective ends of the support members and rib members, and the hooks are adapted for attachment to respective ring members with the outside circumference of the hooks nesting within the concave shaped neck portions of the hubs for pivotal movement about the respective ring members. When the shelter is collapsed, the support members extend downwardly as a bundle from the central hub, the rib members are folded to positions substantially within the bundle of collapsed support members, and the cover is loosely affixed to the frame. In a preferred embodiment, the support members are segmented and can be folded upon themselves to greatly shorten the length of the collapsed bundle thereof.

8 Claims, 5 Drawing Figures

PIVOTAL FRAME STRUCTURE FOR COLLAPSIBLE UMBRELLA TYPE TENT

BACKGROUND OF THE INVENTION

1. Related Applications

This application is related to my concurrently filed applications entitled "Umbrella Type Collapsible Shelter", "Disengaging Connector for Attaching Fabric to a Tubular Support Member", and "Ground Engaging Foot Member", Ser. Nos. 950,028; 950,257; and 950,258, respectively. The entire contents of such concurrently filed applications are incorporated herein by reference.

2. Field

The invention pertains generally to collapsible shelters of the umbrella-tent type. In particular, the invention relates to a portable shelter, including a foldable frame with the shelter cover, i.e., canopy, affixed thereto, which is adapted for quick, easy erection from its folded, compact form and vice-versa.

3. State of the Art

In recent years, backpacking has become very popular, and portable, single unit tents, which have the frame and canopy incorporated into one unit and can be folded into a compact, lightweight package, have been provided to take the place of the older, more cumbersome tents in which a frame and canopy are separable from each other. A sturdy, lightweight, foldable, quickly erectable and collapsible shelter of the umbrella type is disclosed in U.S. Pat. No. 3,794,054, issued to Paul J. Watts on Feb. 26, 1974. In accordance with the disclosure of that patent, a frame and canopy are provided in a single unit wherein the material of the canopy is held loose on the frame when the shelter is in a collapsed position and taut on the frame when the shelter is in an erected position. In addition, the central pole of conventional umbrella-type tents was eliminated, with the shelter retaining all the structural stability of such umbrella tents having a central pole.

The frame of the shelter disclosed in U.S. Pat. No. 3,794,054 includes a vertical erecting rod located at the apex of the frame. The erecting rod is adapted to slide up and down through a central hub which forms the apex of the frame. A plurality of flexible, segmented support members are pivotally attached to the central hub, and an equal number of rib members are pivotally attached at mutually respective ends to the support members. The other ends of the rib members are pivotally attached to a second hub which is mounted on the erecting rod below the central hub, so that when the second hub is moved into proximity of the central hub, the support members assume a position extending outwardly and downwardly from the central hub with the cover or canopy tautly affixed thereto, and the rib members extend substantially radially outward from the second hub. As taught in U.S. Pat. No. 3,794,054, the support members and rib members are pivotally attached to the respective hubs in a substantially permament manner requiring substantial assembly cost. In addition, individual support members or rib members cannot be replaced, in case of breakage or other failure of such a member, without disengagement of all the members attached to the respective hub. Thus, replacement of a single support member or rib member becomes time consuming and costly.

OBJECTIVES

The principal objective of this invention is to provide improved means for pivotally connecting the support members and rib members to their respective hubs. A particular object of the invention is to provide means for releasably connecting the support membes and rib members to their respective hubs quickly, easily, and inexpensively during manufacturing of the shelter. Another object was to provide means whereby individual members are quickly and easily removed from their respective hubs for replacement or other maintenance purposes without removing any of the other members connected to such hubs and without requiring special tools, equipment, or procedures for retaining the other members in proper connection with such hubs during the removal and replacement of the desired member.

SUMMARY OF THE INVENTION

The above objectives are achieved in accordance with the present invention by providing an improved, sturdy, lightweight, foldable, quickly erectable shelter of the type disclosed in U.S. Pat. No. 3,794,054. For that reason, the entire contents of U.S. Pat. No. 3,794,054 are incorporated into this specification by reference.

The shelter in accordance with this invention includes a foldable frame and a cover of sheet material, i.e., canopy, affixed to the frame. The frame comprises an erecting guide upon which first and second hubs are mounted. A plurality of support members are pivotally attached at mutually respective ends to the first hub. When the shelter is in its erected form, the support members extend outwardly and downwardly from the first hub to the ground to provide for the basic superstructure which supports the canopy. A plurality of rib members are pivotally connected at mutually respective ends to the second hub, with the other ends of the rib members being pivotally connected to respective support members. At least one of the first and second hubs is adapted for sliding movement along the erecting guide so that the hubs are adjustable between a position remote from each other to a position proximate or adjacent each other, and the frame of the shelter can be erected and collapsed in a manner similar to the raising and lowering of an ordinary umbrella.

The improvement of the present invention provides novel means for quickly and easily connecting the support members and the rib members to their respective hubs. Such means comprise neck portions in the respective hubs, with ring members encircling the respective neck portions. The support members and rib members are provided with circular, ring-shaped hooks on their respective ends which are to be attached to the respective ring members, with the outside diameter of the hooks being such that the hooks nest within the concave shaped neck portion of the hubs for rigid engagement with the ring members.

Other features and advantages of the invention will become apparent from the following detailed description; taken together with the accompanying drawings.

THE DRAWINGS

Figure 1:
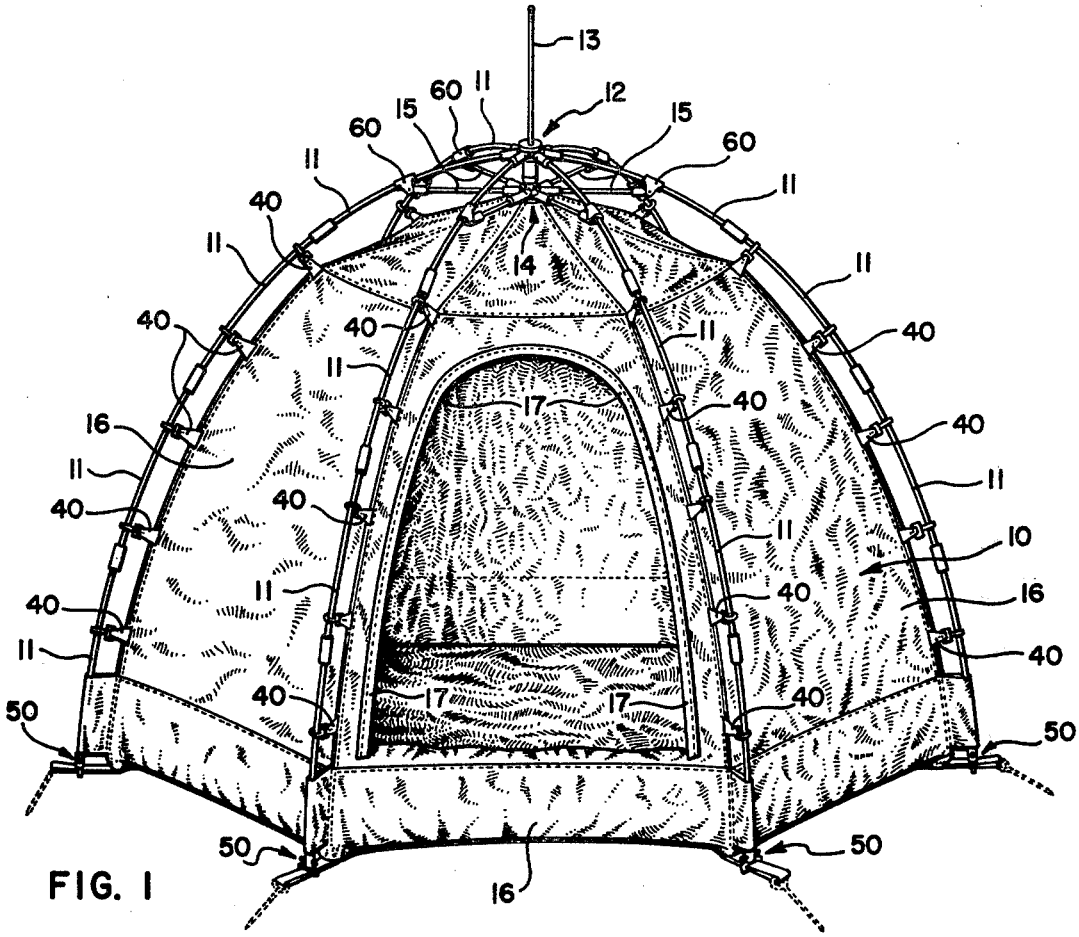
FIG. 1 is a perspective view of a tent in accordance with the invention.
Figure 4:
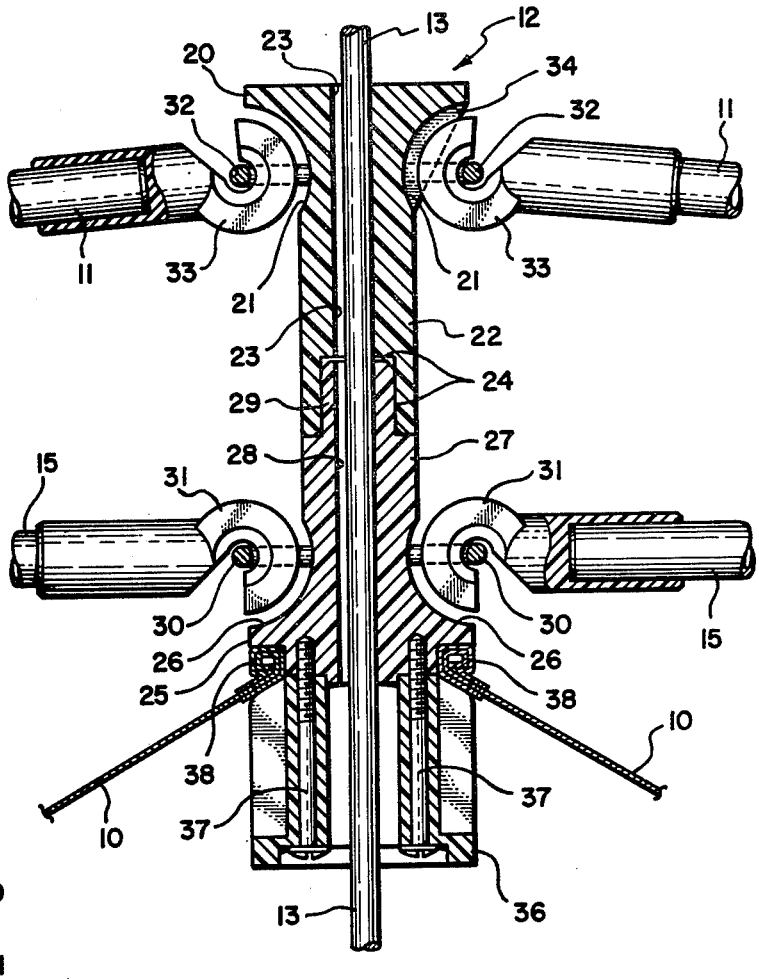
Figure 5:
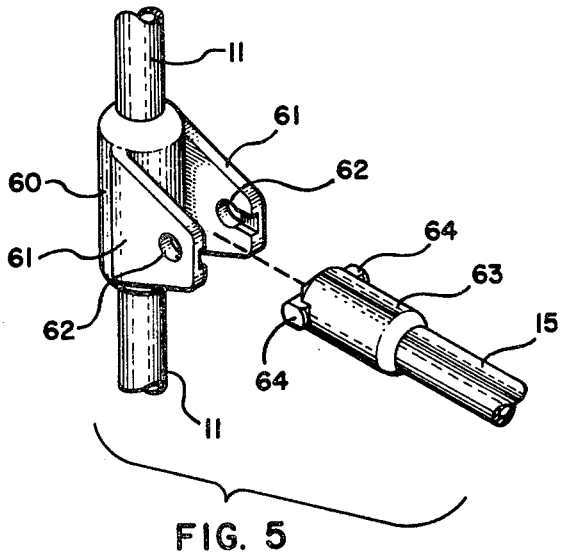

FIG. 4 is an enlarged, vertical section through the erecting rod and associated hubs of the shelter of FIG. 1, with the two hubs being in their positions proximate each other, with a pair of support members and rib members shown pivotally attached to the respective hubs; and FIG. 5 is an exploded perspective of a hinge connecting means for pivotally connecting an end of the rib member to a corresponding support member.

DETAILED DESCRIPTION OF THE ILLUSTRATED EMBODIMENTS

Figure 3:
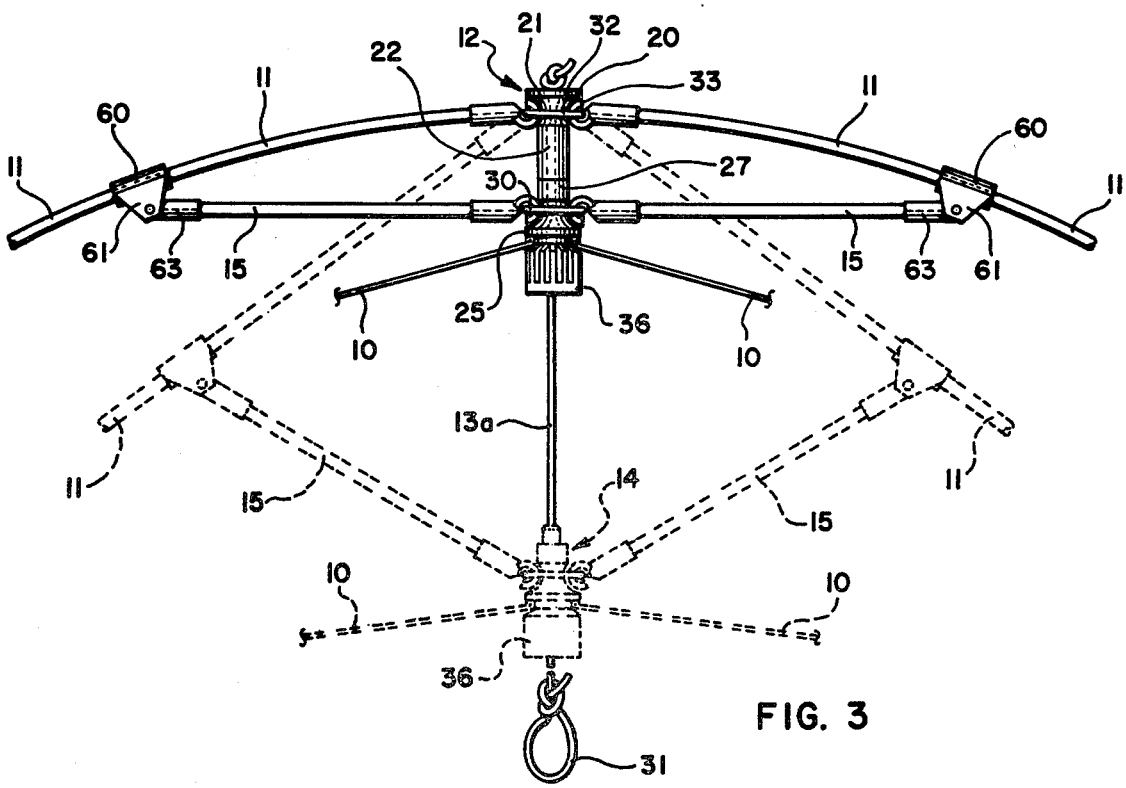
FIG. 3 is a partial elevation of the top section of the shelter of FIG. 1, showing two opposed pairs of support and rib members attached to their respective hubs.
Figure 2:
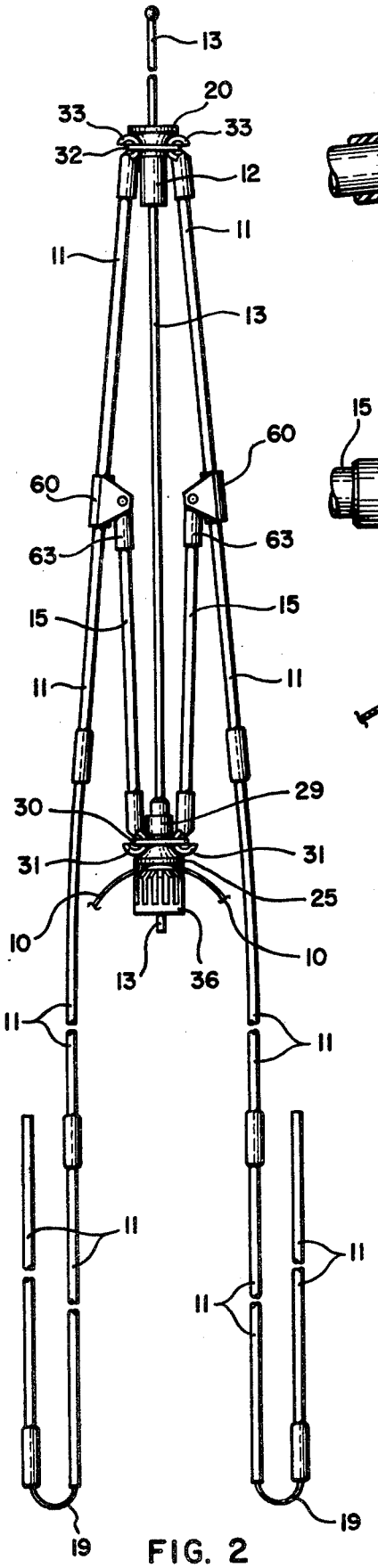
FIG. 2 is a front elevation view of a portion of the frame of the shelter in FIG. 1, with the canopy broken away and the frame in a collapsed and partially folded position.

Referring now to the drawing:

An umbrella-type tent or shelter in accordance with the present invention is shown in general in FIG. 1, with various preferred features and variations of such features illustrated in more detail in FIGS. 2–4. Like parts or assemblies of the tent or shelter are identified by the same numeral in the various figures.

The shelter in the form of an umbrella tent is shown in its erected position in FIG. 1, The tent, as illustrated, has a supporting frame located substantially exterior to the fabric covering or canopy 10 of the tent, such that the fabric or canopy 10 is suspended from the frame. It is, of course, recognized that the supporting frame could be positioned interior of the fabric cover or canopy 10, and such an arrangement is encompassed by the present invention. However, for clarity in describing and illustrating the various features of the present invention, it is expedient to refer to the tent structure having an exterior frame as illustrated in the drawings.

As illustrated, the frame includes a plurality of flexible, segmented support members 11 which are attached at mutually respective ends to a central hub 12. The central hub 12 is mounted on an elongate erecting guide means 13, shown as rod in FIGS. 1, 2, and 4 and as a rope or cord in FIG. 3. In the erected position, as shown in FIG 1, the support members 11 are bowed outwardly and downwardly to form a conical or bell shaped superstructure for supporting the cover of sheet material 10, i.e., the canopy.

A second hub 14 is mounted on the guide means 13 below the central hub 12. At least one of the hubs 12 and 14 is adapted for sliding movement along the erecting rod 13 so that the two hubs 12 and 14 are adjustable between a collapsed position, in which the hubs 12 and 14 are located remote from each other as shown in FIG. 2, and an erected position, in which the hubs 12 and 14 are located proximate or adjacent each other as shown in FIGS. 1, 3, and 4.

A plurality of rib members 15 are pivotally connected at mutually respective ends to the second hub 14, with the other ends of the rib members 15 being pivotally connected to corresponding, respective support member 11, so that when the shelter is in its erected form, the support members 11 extend outwardly and downwardly from the central hub, and the rib members 15 extend substantially radially outwardly from the erecting guide means 13. When the shelter is collapsed, the rib members 15 extend downwardly as shown in FIG. 2, substantially within the support members 11 which extend downwardly as a bundle from the central hub 12, with the support members being in proximate side-by-side relationship with themselves and the rib members 15.

The fabric cover or canopy 10 comprises a plurality of vertical panels 16 (FIG. 1), preferably equal in number to the number of support members 11. The shelter shown in FIG. 1 employs six support members 11 equally spaced around and connected to the central hub 12, and, therefore, the cover or canopy 10 comprises six vertical panels 16. An opening, such as door 17 is provided in one of the panels 16 to provide access to the inside of the tent. As illustrated, the door 17 comprises a zipper which forms an inverted U-shape in the panel, and when the zipper is disconnected the portion of the panel in the inverted U-shaped space falls downwardly to provide the opening into the tent. The opening is closed by zippering the portion of the panel up in its closed position.

Each panel 16 is connected to its two adjacent panels along its respective side edges, and the cover or canopy 10 has a hexagonal, horizontal, cross-sectional shape. A bottom or floor for the shelter can be provided by being connected along the bottom edges of the panels 16. The cover or canopy 10 is attached at several positions along its side edges to the corresponding support member 11 as will be more fully explained hereinafter, so that the points of connection can slide along the support member 11.

In the erection of the shelter of this invention, the rib members 15 are articulated from a position substantially parallel and proximate the vertical centerline of the frame to a position extending substantially radially outwardly from the centerline. During such movement, the support members 11 of the frame are pivoted outwardly from the central hub 12 of the frame. During the initial movement of the rib members 15, the ground engaging ends of the support members 11 move to the outer circumference of the base of the shelter and are restrained from further outward movement by the canopy 10. As the rib members 15 continue to move to a point at which they are substantially perpendicular to the vertical center line of the shelter, the flexible support members are forced into their outwardly bowed shape as shown in FIG. 1. As the rib members 15 move past the position perpendicular to the vertical center line of the shelter, there is a resultant upward force exerted on the second hub 14 due to the stress in the bowed support members 11. This upward force on hub 14 tends to hold it proximate to the central hub 12, thereby maintaining the shelter in the erected position. However, as mentioned previously, it has been found that in normal use of such a shelter, inadvertent, undesired collapse of the shelter often occurs due to various conditions, such as strong winds which cause depression of the apex of the shelter, resulting in the downward movement of the second hub away from the central hub. In accordance with the present invention, means are provided for preventing inadvertent collapse of the shelter due to such downward movement of the second hub 14 away from the central hub 12. In particular, the central hub 12 and second hub 14 are designed to be quickly and releasably connected together as a rigid unit during the erection of the shelter, and by positively holding the two hubs together as a unit, inadvertent, untimely collapse of the shelter is completely prevented.

In a preferred embodiment of the hubs 12 and 14, as shown in the drawings, in particular FIGS. 2–4, the first hub, i.e., the central hub 12, includes an annular upper cap portion or top 20, a narrower diameter neck portion 21 (FIG. 4), and an annular, lower collar portion 22 of a diameter somewhat larger than diameter of the neck portion 21. A cylindrical bore 23 (FIG. 4) extends through the central hub 12, with the elongate erecting guide member 13 passing through the bore 23. The lower end of the first hub 12, i.e., the end thereof which faces the second hub 14, has a counterbore 24 therein which is eccentric with the bore 23, and, therefore eccentric with respect to the longitudinal axis of the erecting guide member 13. The second hub 14 is of a construction similar to that of the first hub 12 in that it comprises an annular bottom cap 25, a narrower diameter neck portion 26 (FIG. 4), and an annular upper collar portion 27 of a diameter somewhat larger than the diameter of the neck portion 26. A cylindrical bore 28 (FIG. 4) extends through second hub 14, with the erecting guide means 13 passing through the bore 28. The upper end of the second hub 14, i.e., the end thereof which faces the first hub 12, has an upstanding cylindrical projection 29 (FIGS. 2 and 4) which is adapted for sliding engagement within the counterbore 24 of the first hub 12. The cylindrical projection is eccentric with the bore 28 and, thus, eccentric with respect to the guide means 13 which passes through bore 28.

As illustrated, at least one of the hubs 12 and 14 is adapted for sliding movement relative to the erecting means 13. In erecting the shelter, the hubs are moved from their collapsed positions as shown in FIG. 2 to their erected positions as best shown in FIGS. 1 and 3 (an intermediate position through which the hubs pass during both the erection or collapse of the shelter is shown by dotted lines in FIG. 3). As can be seen from the drawings, the second hub 14 is moved along the guide means 13 toward the first hub 12 during the erection of the shelter. When the erecting means 13 takes the form of an elongate rod as shown in FIGS. 1, 2, and 4, the second hub 14 can be adapted for slidable movement along the rod, as shown, and when second hub has attained a position adjacent to the first hub 12, the erecting rod 13 is pushed through the bores 23 and 28 of the respective hubs so that it extends upwardly from the first hub 12 on the outside of the shelter as shown in FIG. 1. In an alternative embodiment not shown in the drawings, the lower end of the erecting rod can be attached to or otherwise molded integrally with the second hub 14. Then as the second hub 14 moves toward the first hub 12, in erecting the shelter, the erecting rod concurrently slides through the bore 23 in the first hub 12, so as to extend outside the shelter when the second hub 14 has attained its position adjacent to the first hub 12. Irrespective of whether the erecting guide passes through a bore in the second hub 14 or is attached to or molded integrally therewith, the important aspect is that the elongate guide extends from the free end of the cylindrical extension 29 of the second hub 14 and then through the bore 23 in hub 12.

As mentioned above, the erecting guide means 13 can be a rope or cord 13*a* as shown in FIG. 3. The rope 13*a* passes through the bores 23 and 28 of the respective hubs 12 and 14, with a knot 30 being formed in the upper end thereof which prevents the upper end of the rope 13*a* from being pulled through the bore 23 in the first hub 12. The rope 13*a* hangs downwardly through the bores 23 and 28 of hubs 12 and 14, respectively, and a loop 31 is formed at the downward end thereof for manually grasping the rope 13*a* during erection of the shelter. In erecting the shelter having a rope or cord as the erecting guide means, one hand grasps the loop 31 of the rope 13*a*, and while pulling on the rope 13*a*, the second hub 14 is moved with the other hand upwards along rope 13*a* and into its position proximate to the first hub 12. When the shelter has been erected, the rope 13*a* can be allowed to hang downward from the center of the shelter, or it can be tied back against the inside walls of the shelter using appropriate typing means associated with the inside walls.

Irrespective of whether an elongate rod or a cord or rope is utilized as the erection guide means; the first and second hubs 12 and 14 are quickly connected together as a rigid unit by inserting the cylindrical projection 29 on the second hub 14 into the counterbore 24 of the first hub 12 (see FIG. 4) as the second hub 14 is moved into its position proximate to the first hub 12. The second hub 14 is then rotated by about one-quarter to about three-eighths of a turn about the axis of erecting erecting means, whereupon the erecting means, the first hub 12, and the second hub 14 are bound together as a rigid unit due to the eccentric nature of the counterbore 24 and cylindrical projection 29 in the hubs 12 and 14, respectively. The erecting rod 13 is shown in FIG. 4 undersized for purposes of clarity. In actual practice, the rod 13, or the rope 13*a* of the embodiment shown in FIG. 3, has a diameter just slightly smaller than the bores 23 and 28 of hubs 12 and 14, thereby facilitating the binding action which occurs when the eccentric, cylindrical projection 29 of the second hub 14 is turned within the eccentric counterbore 24 of the first hub 12.

The rib members 15 are connected to the second hub 14 by appropriate means which allows rotation of the hub 14 relative to the rib members 15 and about the longitudinal axis of the erecting guide means 13. The connection means, as illustrated, comprises a neck portion 26 (FIG. 4) formed from a concave-shaped, reduced cross section in the second hub 14 intermediate between upper and lower collar portions 27 and 25 thereof, respectively. A ring-shaped member 30 encircles the neck portion 26 of the second hub 14, and circular, ring-shaped hook members 31 are provided on the respective ends of the rib members 15 for pivotal connection to the ring-shaped members 30. The outer circumference of hook members 31 are such that they nest within the concave-shaped neck portion 26 between the collars 27 and 25 of hub 14. The rib members 15 are, thus, adapted for pivotal movement with respect to the ring member 30 and the hub 14, while the hub 14 is itself adapted for rotational movement without causing any corresponding movement in the ring member 30 or the rib members 15 which are attached to the ring member 30.

The means for pivotally connecting the support members 11 to the first hub 12 is similar to that described above for connecting the rib members 15 to the second hub 14, with the exception that rotation of the first hub 12 about the longitudinal axis of the erecting guide means 13 is prohibited. A ring-shaped member 32 encircles the neck portion 21 (FIG. 4) of hub 12, and hook members 33 are provided on the respective ends of the support members 11 which pivotally hook onto the ring-shaped member 32. The neck portion 21 is formed from concave-shaped, reduced cross section in the first hub 12 intermediate between an upper cap portion 20 and a lower collar portion 22, respectively. The outer diameters of hook members 31 are such that they nest within the concave-shaped neck portion 21 between the cap portion 20 and collar portion 22 of the hub 12. To eliminate any substantial rotation of the first hub 12 comparable to the one-quarter to three-eighths turn of the second hub 14, a web member 34 (FIG. 4) bridges the collar portions 20 and 22 across the neck portion 21 of the first hub 12. As illustrated in FIG. 4, the web member 34 comprises a pin extending from the upper cap portion 20 to the lower collar 22, across the neck portion 21. The web member 34 could also be molded integrally with the first hub 12, wherein the web would comprise a relatively thin vertically standing sheet member extending radially outwardly from the neck portion 21 of hub 12. Whether in the form of a sheet, pin, or otherwise, the web member 34 is sized and positioned to fit closely between the hook members 33 of two adjacent support members 11, so that the first hub 12 is restrained from any substantial rotational movement about the longitudinal axis of the erecting guide means 13.

In addition to providing for pivotal connection of the rib members 15 and the support members 11 to their respective hubs 12 and 14, the connecting means as described above also provides for quickly, easily, and inexpensively connecting the rib members 15 and support members 11 to their respective hubs during manufacture of the shelter. Further, individual support members 11 and/or rib members 15 can be quickly and easily removed from their respective hubs 12 and 14 for replacement or other maintenance purposes without removing any of the other members connected to such hubs, and without requiring special tools, equipment, or precedures for retaining the other members in proper connection with such hubs during the removal and replacement of the desired member.

In the embodiment of the invention, which has been described hereinabove, the functions of the first, i.e., central hub 12, and the second hub 14 have been assigned in accordance with one preferred mode of carrying out the invention. It should be understood, however, that at least a portion of the functions assigned to the first and second hubs 12 and 14 could be reversed. For example, the first hub 12 could be adapted for rotation about the axis of the erecting guide 13, and the second hub 14 could be restrained from rotational movement. The erecting guide 13 could then be pulled upwardly through the first or top hub 12, with the top hub being rotated to lock the mechanism.

In general, at least one of the first and second pivotal connecting means (the first means being that which connects the support members 11 to the first or central hub 12 and the second means being that which connects the rib members 15 to the second hub 14) is adapted to allow rotational movement of the mutually respective hub about the longitudinal axis of the guide member 13. One of the first and second hubs 12 and 14, respectively, is provided with a counterbore 24 in the end thereof facing the other hub, with the counterbore 24 being eccentric with the bore 23 which extends through the first hub 12, and, therefore, eccentric with respect to the erecting member 13. The other hub has an upstanding cylindrical portion 29 which is adapted for sliding engagement within the counterbore 24 when the two hubs are moved into their position proximate each other. The upstanding portion 29 is eccentric with respect to the erecting guide 13, and as fully described hereinbefore, when the upstanding portion 29 is engaged in the counterbore 24 and the rotatable hub is rotated by about one-quarter to three-eighths of a turn about the longitudinal axis of the erecting guide 13, the hubs 12 and 14 are bound together with the erecting rod 13 as a rigid unit.

The apex of the cover or canopy 10 of the shelter is attached, as illustrated in the drawings, to the lower end of the second hub 14. As illustrated in FIGS. 2–4, a handle member 36 is attached to the lower end of second hub 14 by counter-sunk screws 37. A circumferential notch is provided between the lower end of the second hub 24 and the top of handle 36, and a ring 38, to which the apex of the cover or canopy 10 is attached, is held within the circumferential notch. The apex of the cover 10 is, thus, easily removed from the frame of the shelter by removing the handle 36 from the second hub 14 thereby freeing the ring 38. The handle 36 is also useful in providing means for manipulating the second hub 14 during the erection and collapsing of the shelter.

The remaining portion of the cover 10 is attached, at various points intermediate its apex and the bottom edge, to the support members 11. As illustrated in FIG. 1, a plurality of straps 40 are provided at spaced intervals along the seam connecting adjacent panels 16 of the cover 10. The ends of the straps 40 extending from the cover 10 are adapted to be connected to the support members 11 for sliding movement therealong. The straps 40 are freely slidable along their respective support members 11, so that the cover 10 readily slides along the support members during erection of the tent as well as when the tent is being taken down and made ready for storage.

Preferred means for pivotally attaching mutually respective ends of the rib members 15 to corresponding respective support members 11 is shown in FIGS. 3 and 5. As shown, hinge members 60 are mounted on respective support members 11, each hinge member 60 having a pair of substantially flat lugs 61 extending from mutually opposite sides of the respective support member 11 inwardly in substantially parallel relationship toward the central portion of the shelter. The flat lugs 61 have opposed openings 62 (FIG. 5) having a common axis through the lugs. Corresponding pin members are positioned on the ends of the respective rib members 15 which are adapted to be snapped into engagement with the opposed openings 62 in the hinge members 60, so that the respective rib member 15 can pivot about the common axis of the openings 62. Preferably, the pin members comprise cylindrical cap members 63 which are adapted to slide over the ends of the respective rib members 15. Each of the cap members 63 has a pair of pegs 64 (FIG. 5) extending outwardly in opposite directions from the end thereof, whereby the pegs 64 are adapted to be snapped into engagement with the openings 62 in the hinge member 60.

As mentioned hereinbefore, each of the support members 11 is preferably segmented so that the collapsed shelter can be folded into a compact package. As shown in FIG. 2, each support member 11 preferably comprises a plurality of cylindrical sections, with elastic means extending through the cylindrical sections. The ends of adjacent cylindrical sections are provided with, respectively, a male end and a female end for interconnectingly coupling the sections together. The elastic means (shown by numeral 19 in FIG. 2) maintains continuity between adjacent sections when they are in their folded form, as well as urges the adjacent sections into longitudinal coupling relationship when the sections are brought into end-to-end position. Particular constructions of such segmented members 11 are fully described in U.S. Pat. No. 3,794,054.

While the preferred embodiment of the collapsible shelter has been described above for use mainly as a tent, the invention can also be used to construct a floorless, clothes-changing shelter for use, for example, at the beach. The invention can also be used to design a very large collapsible beach umbrella, in which case the erecting means 13 would comprise a rod extending downwardly to the ground and support members 11 would extend only to the edge of a canopy-type cover.

Although the invention has been described in detail with respect to particularly preferred embodiments thereof, it will be understood by those of ordinary skill in the art that variations and modifications may be effected without departing from the subject matter coming within the scope of the following claims, which subject matter is regarded as the invention.

I claim:

1. In a collapsible shelter of the umbrella-tent type wherein the shelter includes a foldable frame and a cover of sheet material affixed to the frame, with said frame comprising an erecting guide; a plurality of support members for supporting said cover when said frame is erected; a first hub mounted on said erecting guide; means for pivotally connecting mutually respective ends of said support members to said first hub, so that when the shelter is erected, the support members extend outwardly and downwardly from said first hub, and when the shelter is collapsed, the support members extend downwardly as a bundle, with the support members being in proximate side-by-side relationship; a second hub mounted on said erecting guide below said first hub, said first and second hubs being adjustable between a collapsed position, in which said first and second hubs are located at the top and bottom of said erecting guide, respectively, and an erected position, in which the first and second hubs are proximate to each other; a plurality of rib members, equal in manner to the number of support members; means for pivotally connecting mutually respective ends of said rib members to the second hub; means for pivotally connecting the other mutually respective ends of said rib members to corresponding support members, such that when the shelter is erected, said rib members extend substantially radially outwardly from said erecting guide, and when the shelter is collapsed, said rib members extend downwardly, substantially within said bundle of collapsed, support members; the improvement wherein:

the means for pivotally connecting said support members to said first hub comprises a neck portion in said first hub formed from a concave-shaped, reduced cross section in said first hub intermediate between an upper cap portion and a lower collar portion of said first hub; a ring member encircling said neck portion; and circular, ring-shaped hooks on the respective ends of the support members which are adapted to be attached to said ring member, with the outside circumference of the hooks being such that the hooks nest within the concave shaped neck portion of said first hub for pivotal movement about said ring member which encircles said neck portion.

2. The improved, collapsible shelter in accordance with claim 1, wherein each of the hooks on the ends of the support members comprises a cylindrical base having one end thereof adapted for concentric attachment to the end of its mutually respective support member, (with the other end of the cylindrical base having one end threof adapted for concentric attachment to the end of its mutually respective support member,) with the other end of the cylindrical base extending coaxially from said end of said support member, said other end having the circular, ring-shaped hook formed integrally thereon.

3. The improved, collapsible shelter in accordance with claim 2, wherein the hooks are formed from a molded polymer.

4. The improved, collapsible shelter in accordance with claim 1, wherein the means for pivotally connecting the rib members to the second hub comprises a neck portion in said second hub formed from a concave-shaped, reduced cross section in said second hub intermediate between upper and lower collar portions of said second hub; a second ring encircling the neck portion in said second hub; and circular, ring-shaped hooks on the respective ends of the rib members for pivotal attachment of such ends of said rib members to said second ring, with the outside circumference of the hooks being such that the hooks nest within the concave-shaped neck portion of said second hub for pivotal movement about said second ring.

5. The improved, collapsible shelter in accordance with claim 4, wherein each of the hooks on the ends of the rib members comprises a cylindrical base having one end thereof adapted for concentric attachment to the end of its mutually respective rib member, with the other end of the cylindrical base extending coaxially from said end of said rib member, said other end having the circular, ring-shaped hook positioned integrally thereon.

6. The improved, collapsible shelter in accordance with claim 5, wherein the hooks on the ends of the rib members are formed from a molded polymer.

7. The improved, collapsible shelter in accordance with claim 4, wherein the means for pivotally connecting said other mutually respective ends of said rib members to corresponding support members comprises hinge members mounted on respective support members, each of the hinge members having a pair of substantially flat lugs extending in substantially parallel relationship inwardly toward the central portion of said shelter from mutually opposite sides of the respective support member to which the hinge is mounted, said flat lugs having opposed openings on a common axis through the lugs; and pin members on the respective ends of said rib members which are adapted to be snapped into engagement with the opposed openings in said hinge members, so that said rib member can pivot about said common axis of said openings.

8. The improved, collapsible shelter in accordance with claim 7, wherein said pin members comprise cylindrical cap members adapted to slide over the ends of the respective rib members, each of said cap members having a pair of pegs extending outwardly in opposite directions from the end thereof, whereby said pegs are adapted to be snapped into engagement with the openings in the hinge member.

* * * * *